US012788125B2

(12) United States Patent
Liu

(10) Patent No.: US 12,788,125 B2
(45) Date of Patent: Nov. 10, 2026

(54) ENVIRONMENTALLY FRIENDLY VALVE

(71) Applicant: CHUEN CHURN CO., LTD., New Taipei City (TW)

(72) Inventor: Ting Nan Liu, New Taipei City (TW)

( * ) Notice: Subject to any disclaimer, the term of this patent is extended or adjusted under 35 U.S.C. 154(b) by 71 days.

(21) Appl. No.: 18/780,713

(22) Filed: Jul. 23, 2024

(65) Prior Publication Data

US 2026/0026599 A1 Jan. 29, 2026

(51) Int. Cl.
*A45D 40/26* (2006.01)
*A45D 40/00* (2006.01)

(52) U.S. Cl.
CPC ..... *A45D 40/26* (2013.01); *A45D 2040/0006* (2013.01); *A45D 2200/055* (2013.01)

(58) Field of Classification Search
None
See application file for complete search history.

(56) References Cited

U.S. PATENT DOCUMENTS 3,529,899 A * 9/1970 Gruska ..... A45D 34/046 401/121
7,175,360 B2 * 2/2007 Zhang ..... A45D 34/04 401/206
7,287,927 B2 * 10/2007 Zhang ..... B65D 47/42 401/278
7,988,377 B2 * 8/2011 Zhang ..... B65D 35/22 401/44
9,185,959 B2 * 11/2015 Pires ..... A45D 34/042
9,867,444 B1 * 1/2018 Liu ..... A46B 9/021
10,244,843 B2 * 4/2019 Liu ..... A45D 34/04
10,271,628 B2 * 4/2019 Liu ..... A45D 34/042
2006/0140708 A1 * 6/2006 Byun ..... A46B 11/0086 401/269
2013/0112314 A1 * 5/2013 Lee ..... A45D 40/267 141/23
2013/0315645 A1 * 11/2013 Gutberlet ..... A45D 40/28 401/98
2014/0124541 A1 * 5/2014 Mathiez ..... B65B 3/04 222/207
2018/0332946 A1 * 11/2018 Liu ..... A45D 34/04
2018/0344007 A1 * 12/2018 Huang ..... A45D 40/26
2020/0315318 A1 * 10/2020 Lee ..... B05B 11/0038
2022/0192344 A1 * 6/2022 Lee ..... B05B 11/0013
2023/0013434 A1 * 1/2023 Kim ..... B05B 11/0013

* cited by examiner

*Primary Examiner* — Nicholas D Lucchesi
(74) *Attorney, Agent, or Firm* — Rosenberg, Klein & Lee

(57) ABSTRACT

A valve is environmentally friendly and includes an applicator head; a plunger including an annular first flange, a fastening member projecting from a first end of the first flange with the applicator head disposed thereon, a cylinder extending from a second end of the first flange, and an axial channel through the plunger; a sleeve including a main body, an axial space through the main body for receiving the cylinder, a tapered member projecting from a first end of the main body, an annular third flange at a second end of the main body, and at least one exit at an edge of the tapered member and communicating with the space; and a hollow, cylindrical resilient member on the cylinder and in the space.

13 Claims, 10 Drawing Sheets

ENVIRONMENTALLY FRIENDLY VALVE

FIELD OF THE INVENTION

The invention relates to valves and more particularly to an environmentally friendly valve.

BACKGROUND OF THE INVENTION

A conventional valve is provided in an opening of a cosmetic applicator and comprises a sleeve, a hollow plunger, a metal helical spring, and an exit member. The sleeve includes a plurality of dispensing holes at one end. The helical spring is put on one end of the plunger and together they are disposed in a space of the sleeve. The other end of the plunger is disposed in the exit member. Finally, the sleeve is disposed at the opening of the cosmetic applicator. The plunger may move axially in response to expansion or compression of the helical spring. And in turn, the dispensing holes may open or close in a movable manner. As a result, the cosmetic fluid in the applicator may flow out for application or not in an airtight manner.

However, the cosmetic fluid may flow into the exit member from gaps between the components after a long period of time of use. The remaining cosmetic fluid may deteriorate if the leaked cosmetic fluid contacts the helical spring. Further, the helical spring may rust. Furthermore, the cosmetic fluid may clog gaps between the helixes of the helical spring. This can decrease elasticity of the helical spring. In addition, the cosmetic applicator may be recycled after the cosmetic fluid has been consumed. However, the helical spring is required to detach from the remaining components of the cosmetic applicator prior to the recycling due to different materials of the components. In short, the recycling of the helical spring and that of the plastic remaining components (e.g., the exit member and the cosmetic applicator itself) are done in different processes. Otherwise, the recycling machine may malfunction or even be damaged. This not only bothers the recycling company but also is not environmentally friendly.

Thus, the need for improvement still exists.

SUMMARY OF THE INVENTION

It is therefore one object of the invention to provide a valve comprising an applicator head; a plunger including an annular first flange, a fastening member projecting from a first end of the annular first flange with the applicator head disposed thereon, a cylinder extending from a second end of the annular first flange, and an axial channel disposed through the plunger; a sleeve including a main body, an axial space disposed through the main body for receiving the cylinder, a tapered member projecting from a first end of the main body, an annular third flange disposed at a second end of the main body, and at least one exit disposed at an edge of the tapered member and communicating with the axial space; and a hollow, cylindrical resilient member made of flexible plastic material and disposed on the cylinder and in the axial space.

The invention has the following advantages and benefits in comparison with the conventional art: the resilient member is made of flexible plastic material. Thus, the resilient member can be recycled with a plastic cap and a plastic casing in one process. It is environmentally friendly. After the plunger, the sleeve and the resilient member have been assembled, an airtight valve is implemented by operating same. Air is prevented from entering the casing and any leaked cosmetic fluid is prevented from flowing back to the casing. Quality of the cosmetic fluid is maintained. The resilient member is prevented from rusting. A useful life of the cosmetic applicator is prolonged greatly.

The above and other objects, features and advantages of the invention will become apparent from the following detailed description taken with the accompanying drawings.

DETAILED DESCRIPTION OF THE INVENTION

Figure 1:
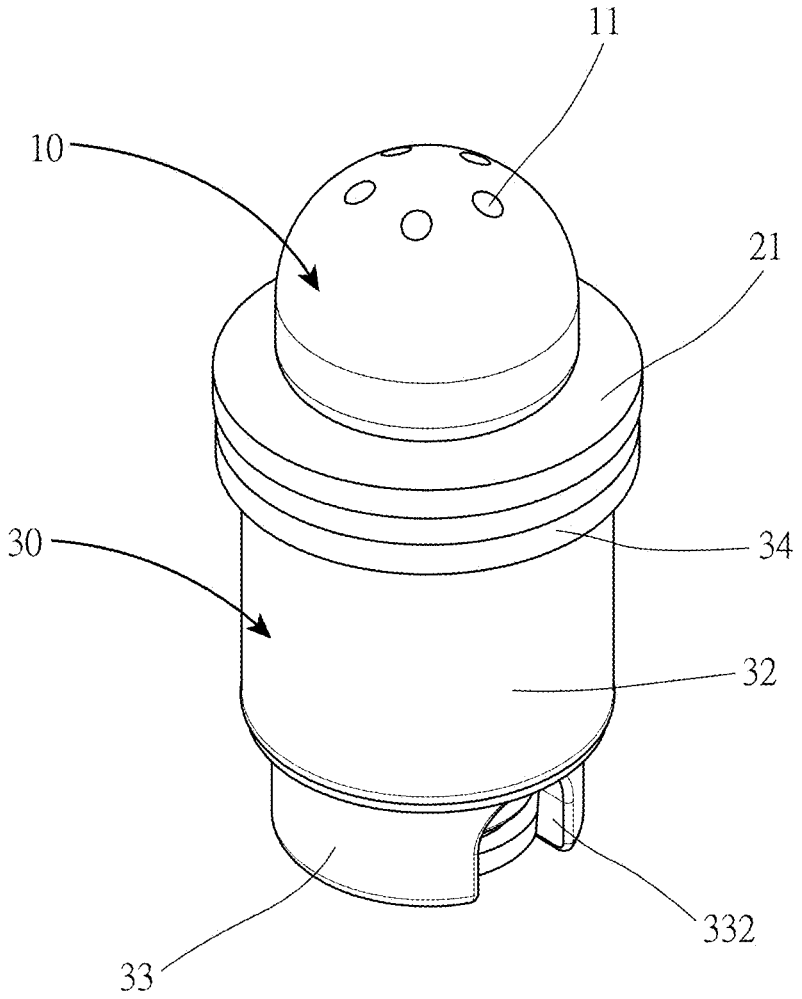
FIG. 1 is a perspective view of an environmentally friendly valve according to a first preferred embodiment of the invention.
Figure 2:
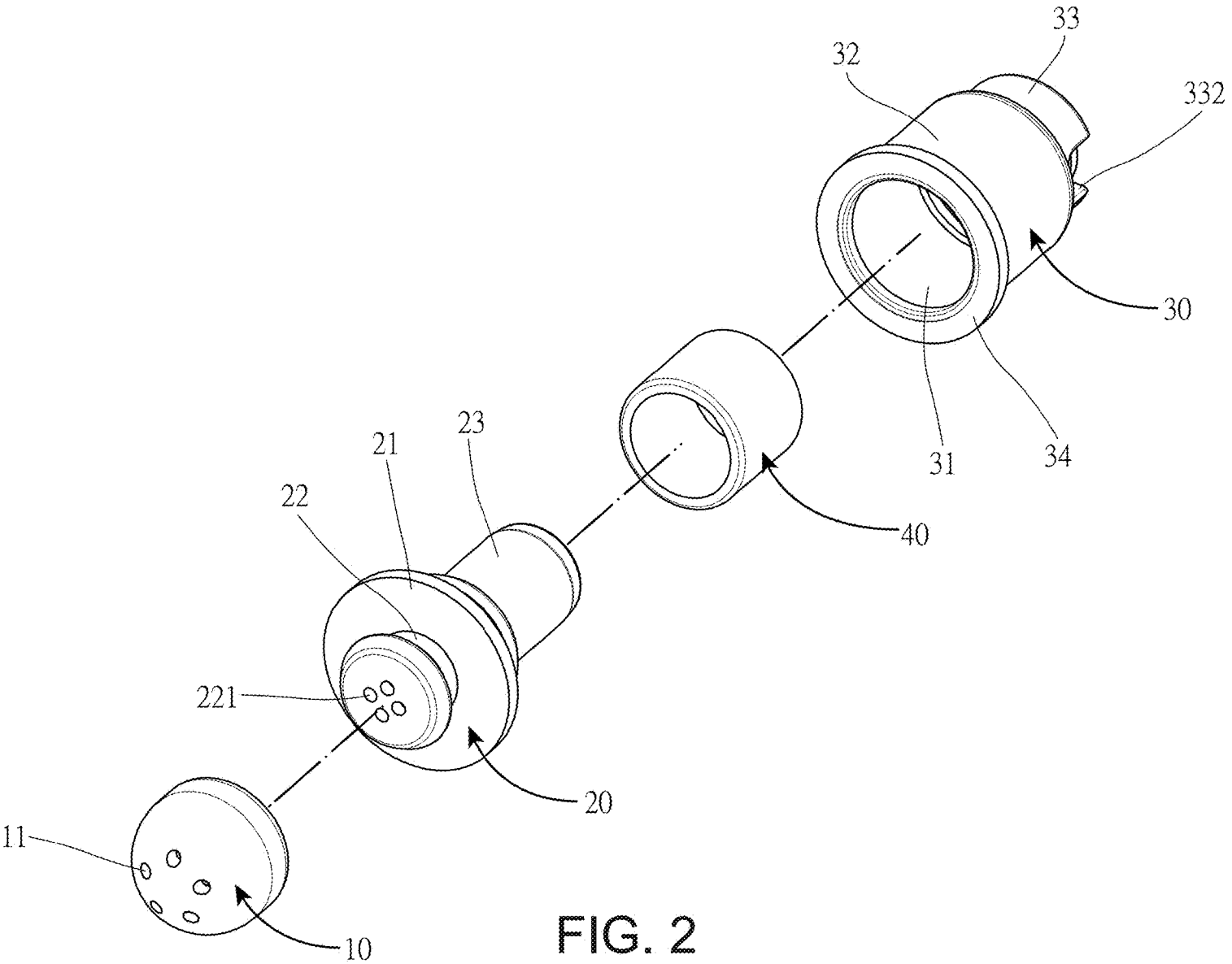
FIG. 2 is an exploded view of the environmentally friendly valve.
Figure 3:
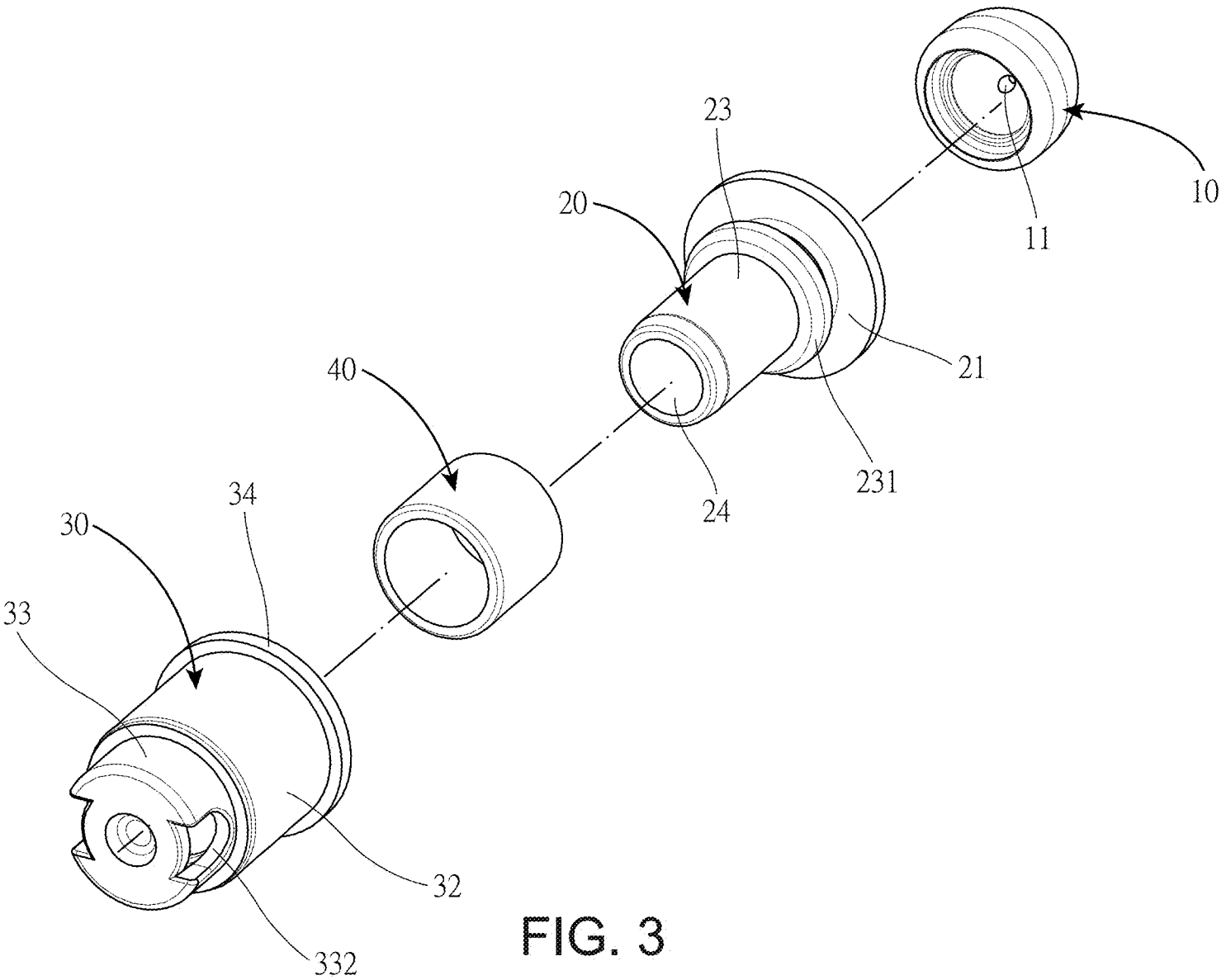
FIG. 3 is another exploded view of the environmentally friendly valve viewed from an opposite angle.
Figure 4:
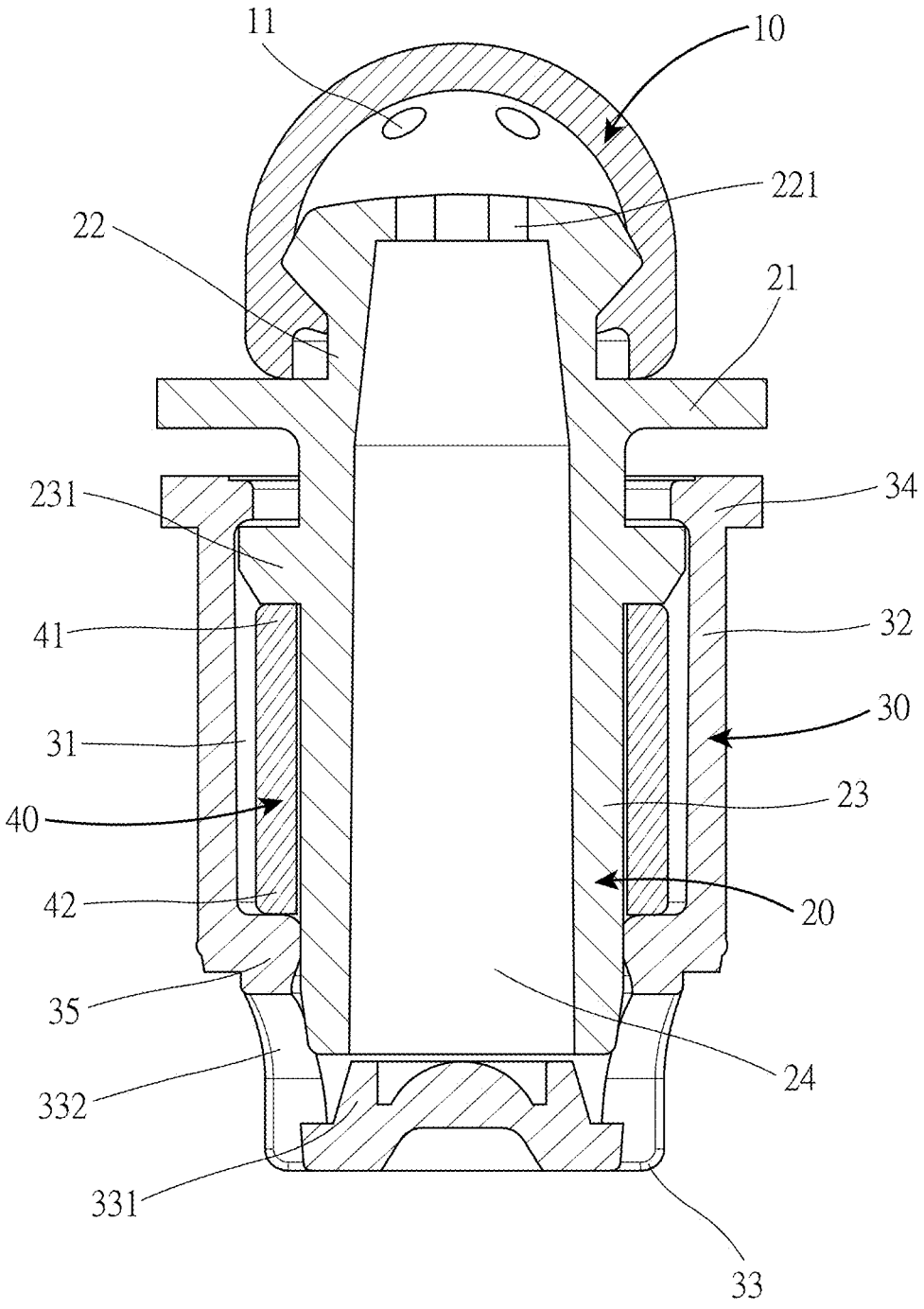
FIG. 4 is a longitudinal sectional view of the environmentally friendly valve.

Referring to FIGS. 1 to 4, an environmentally friendly valve in accordance with a first preferred embodiment of the invention comprises the following components as discussed in detail below.

A hollow applicator head 10 includes a plurality of first dispensing holes 11. In the embodiment, the applicator head 10 is half-spherical and made of thermoplastic polyester elastomer (TPEE).

A hollow plunger 20 includes an annular first flange 21, a fastening member 22 projecting from a first end of the first flange 21 with the applicator head 10 disposed thereon, the fastening member 22 having a plurality of second dispensing holes 221, a hollow cylinder 23 extending from a second end of the first flange 21 and having an annular second flange 231, the second flange 231 on an outer surface of the cylinder 23 is adjacent to the annular first flange 21, and an axial channel 24 through the plunger 20 to communicate with the second dispensing holes 221.

A sleeve 30 includes a main body 32 with an axial space 31 disposed therein for receiving the cylinder 23, a tapered member 33 projecting from a first end of the main body 32, the tapered member 33 having an internal conic projection 331 and a plurality of exits 332 at an edge and communicating with the space 31, an annular third flange 34 at a second end of the main body 32, and an internal annular shoulder 35 at a joining portion of an inner surface of the main body 32 and an inner surface of the tapered member 33, the shoulder 35 urging against an outer surface of the cylinder 23.

A hollow, cylindrical resilient member 40 is made of flexible plastic material such as silicone or thermoplastic elastomer (TPE) in the embodiment. The resilient member 40 has smooth inner and outer surfaces in non-limiting purposes. The resilient member 40 is disposed on the cylinder 23 and in the space 31. The resilient member 40 has a first end 41 urging against the second flange 231, and an opposite second end 42 urging against the shoulder 35.

Figure 5:
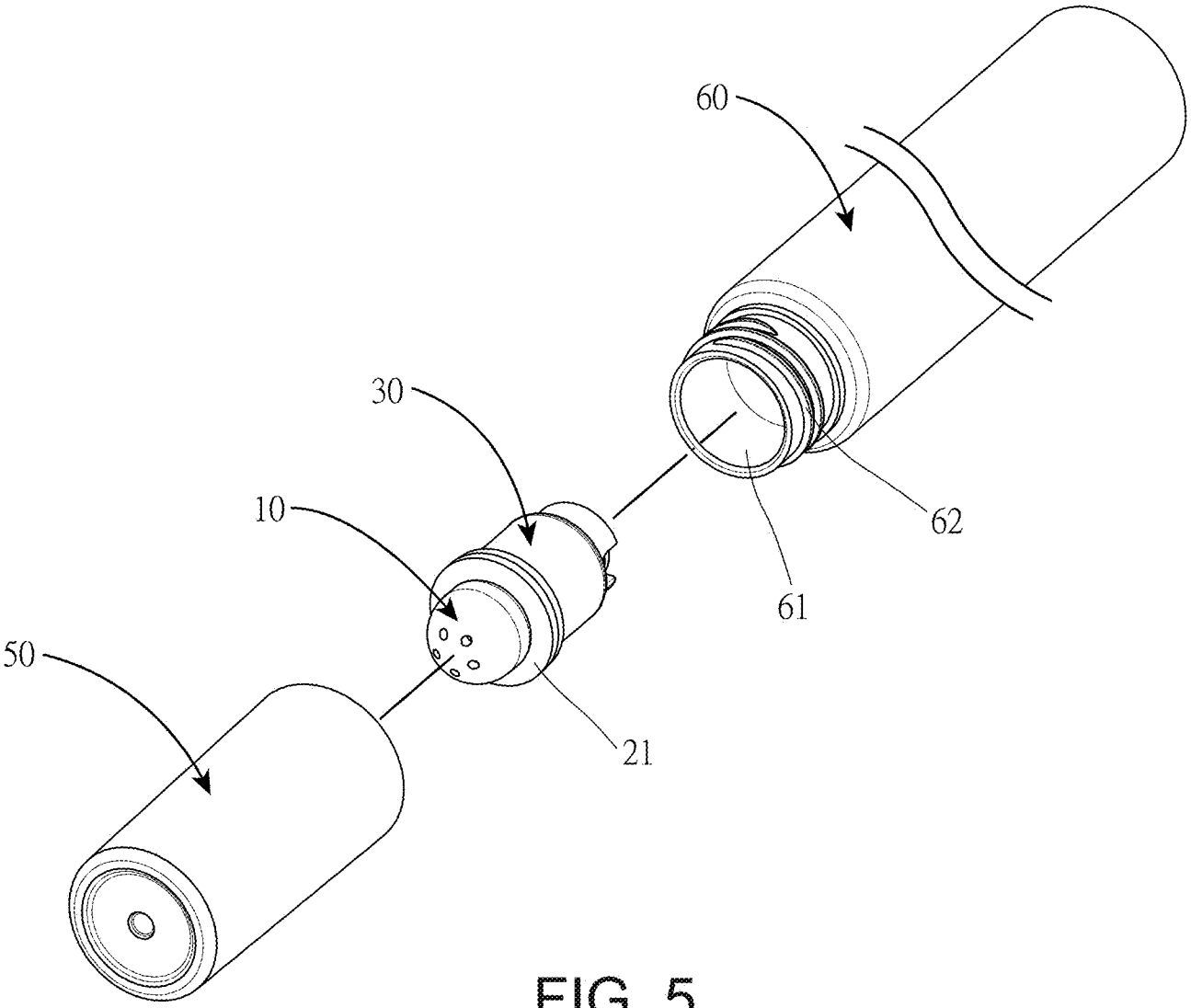
FIG. 5 is an exploded view of a cap, a casing and the environmentally friendly valve.
Figure 6:
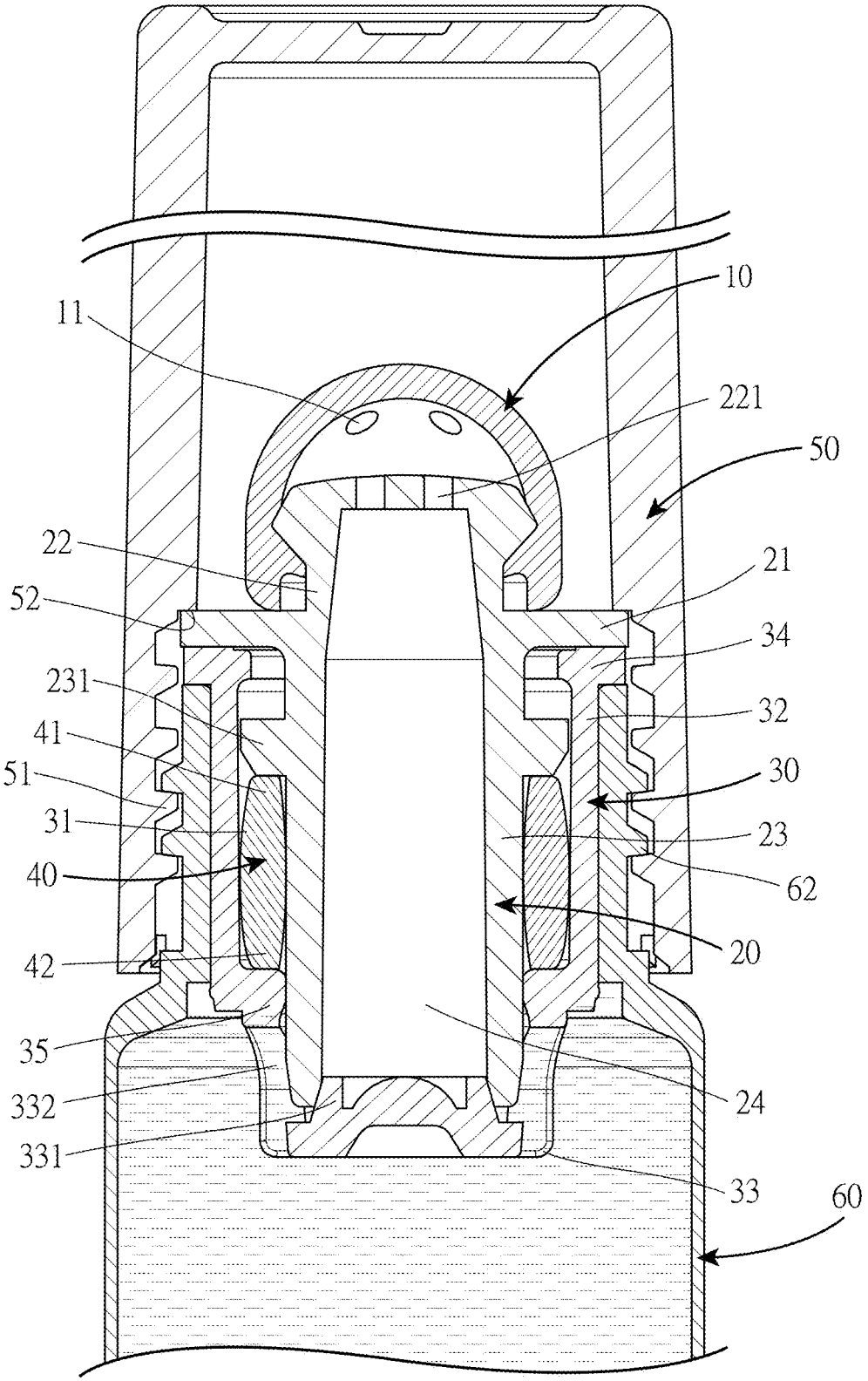
FIG. 6 is a longitudinal sectional view of the assembled cap, the casing and the environmentally friendly valve.

Referring to FIGS. 5 and 6, the environmentally friendly valve cooperates with a cap 50 and a casing 60 filled with cosmetic fluid in use. The cap 50 includes an internally threaded member 51 on an inner surface and an annular shoulder member 52 at an inner end of the internally threaded member 51. The casing 60 includes an opening 61 with the sleeve 30 disposed therein and the third flange 34 urging against an end of the opening 61, and an externally threaded member 62 on an outer surface of the opening 61 and threadedly secured to the internally threaded member 51 so as to enclose the applicator head 10 in the cap 50.

The cap 50 is threadedly secured to the casing 60 with the internally threaded member 51 threadedly secured to the externally threaded member 62 in an unused position. Further, the first flange 21 is urged by the shoulder member 52, the first flange 21 urges against the third flange 34, and the second flange 231 compresses the resilient member 40. As such, the cylinder 23 moves toward the projection 331 and urges against same. As a result, the exits 332 are blocked to prevent the cosmetic fluid from flowing out of the casing 60.

Figure 7:
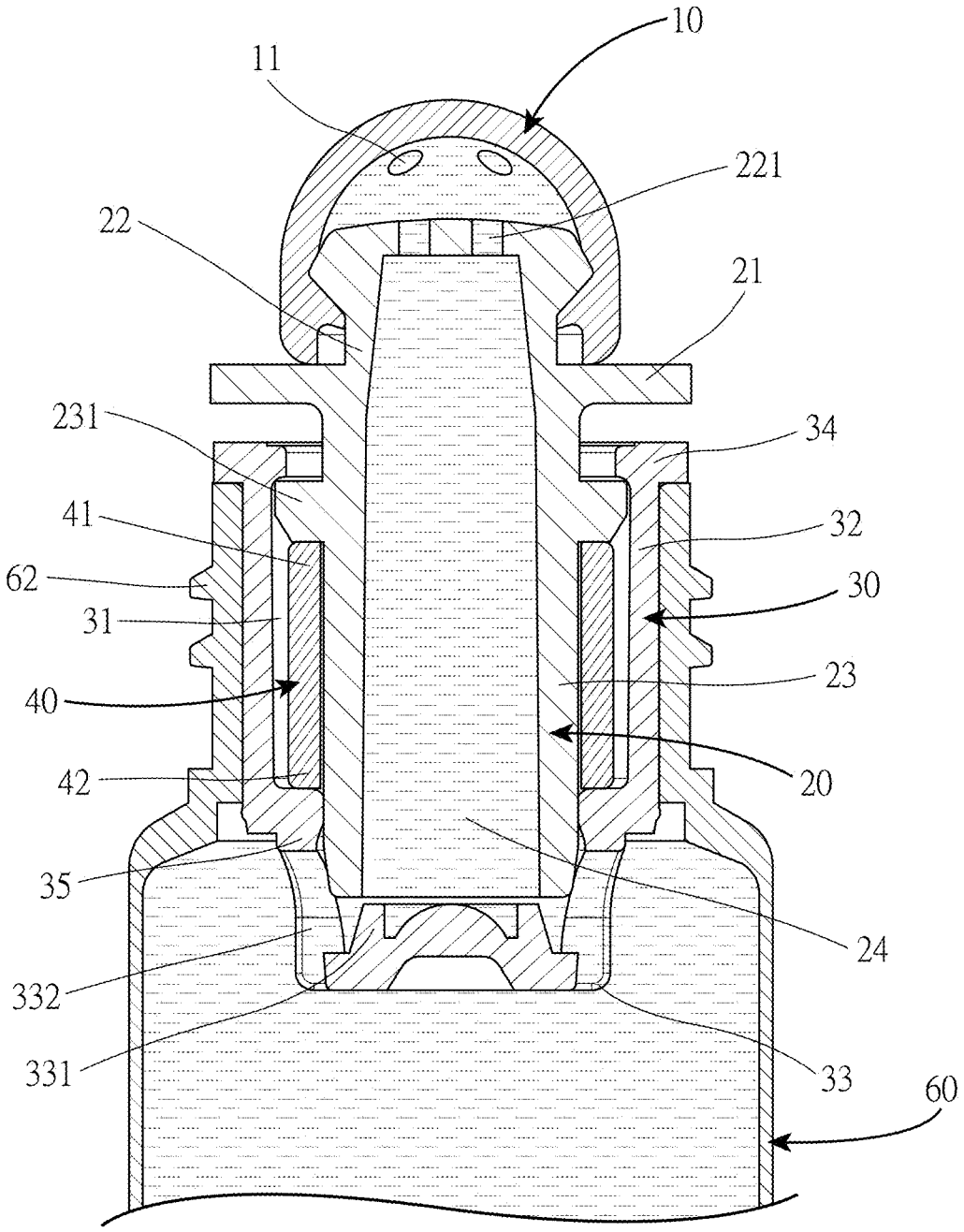
FIG. 7 is a view similar to FIG. 6 with the cap removed and cosmetic fluid flowed out for application.

Referring to FIG. 7 in conjunction FIG. 6, regarding application of cosmetic fluid, a user may first unfasten and remove the cap 50. After the cap 50 has been removed, the second flange 231 is pushed by the resilient member 40 until being blocked by the third flange 34 in which the plunger 20 axially moves to disengage the first flange 21 from the third flange 34 and disengage the cylinder 23 from the projection 331 to open the exit 332. At this time, the cosmetic fluid in the casing 60 flows through the exits 332 into the channel 24 and further flows through the second dispensing holes 221 and the first dispensing holes 11. The cosmetic fluid flowed out of the first dispensing holes 11 may be uniformly applied to a desired body part by the user manipulating the applicator head 10. It is envisaged by the invention that with the cooperation of the plunger 20, the sleeve 30, and the resilient member 40, advantages including a uniform and a measured quantity of the cosmetic fluid being applied, preventing cosmetic fluid from leaking in an airtight manner, and preventing cosmetic fluid from being polluted by air can be obtained.

Figure 8:
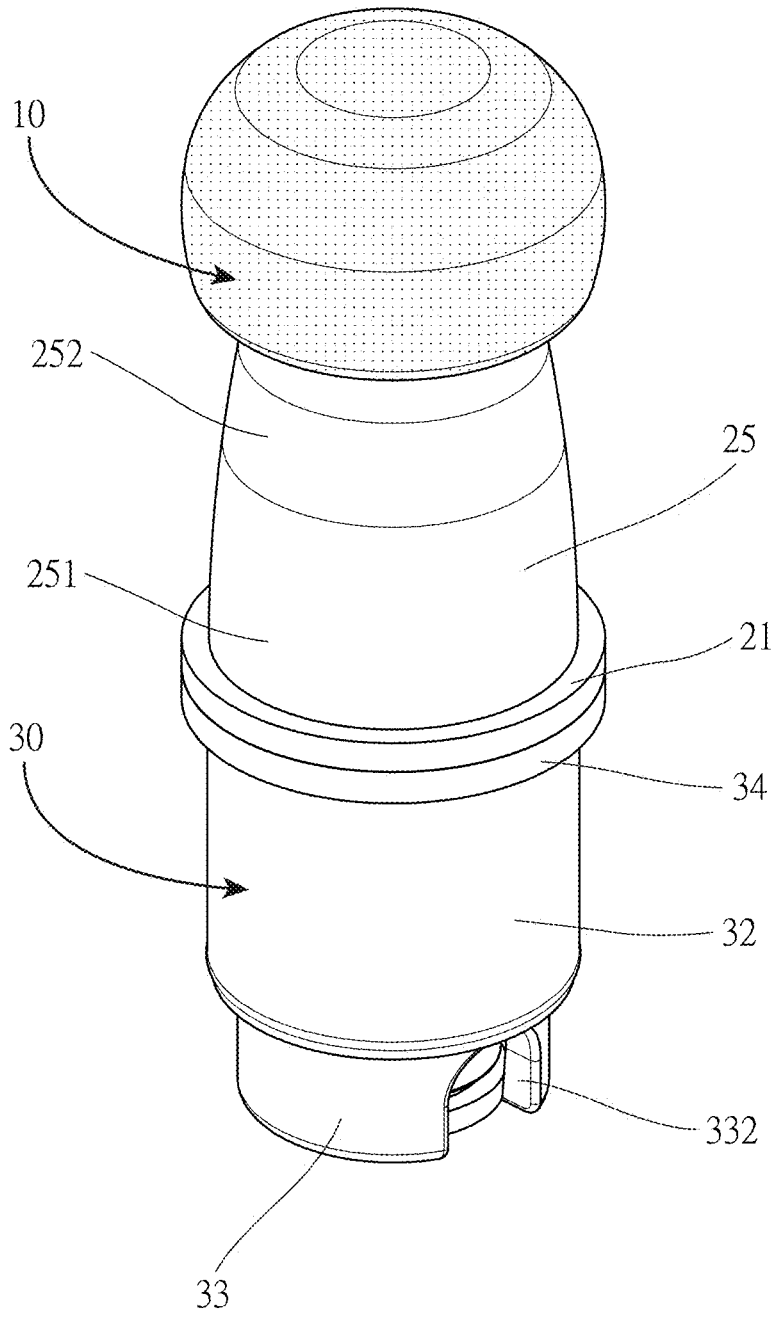
FIG. 8 is a perspective view of an environmentally friendly valve according to a second preferred embodiment of the invention.
Figure 9:
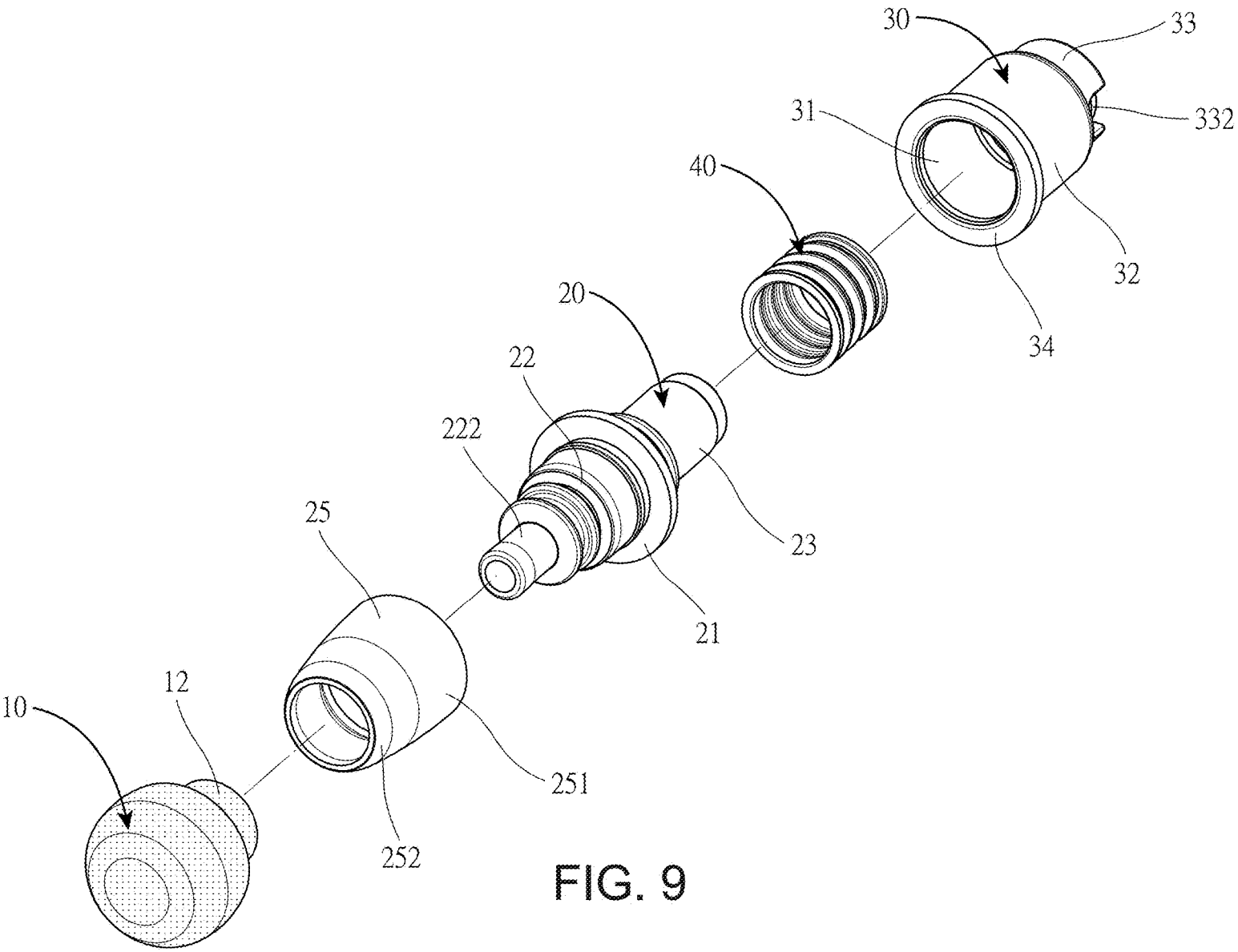
FIG. 9 is an exploded view of the environmentally friendly valve in FIG. 8.
Figure 10:
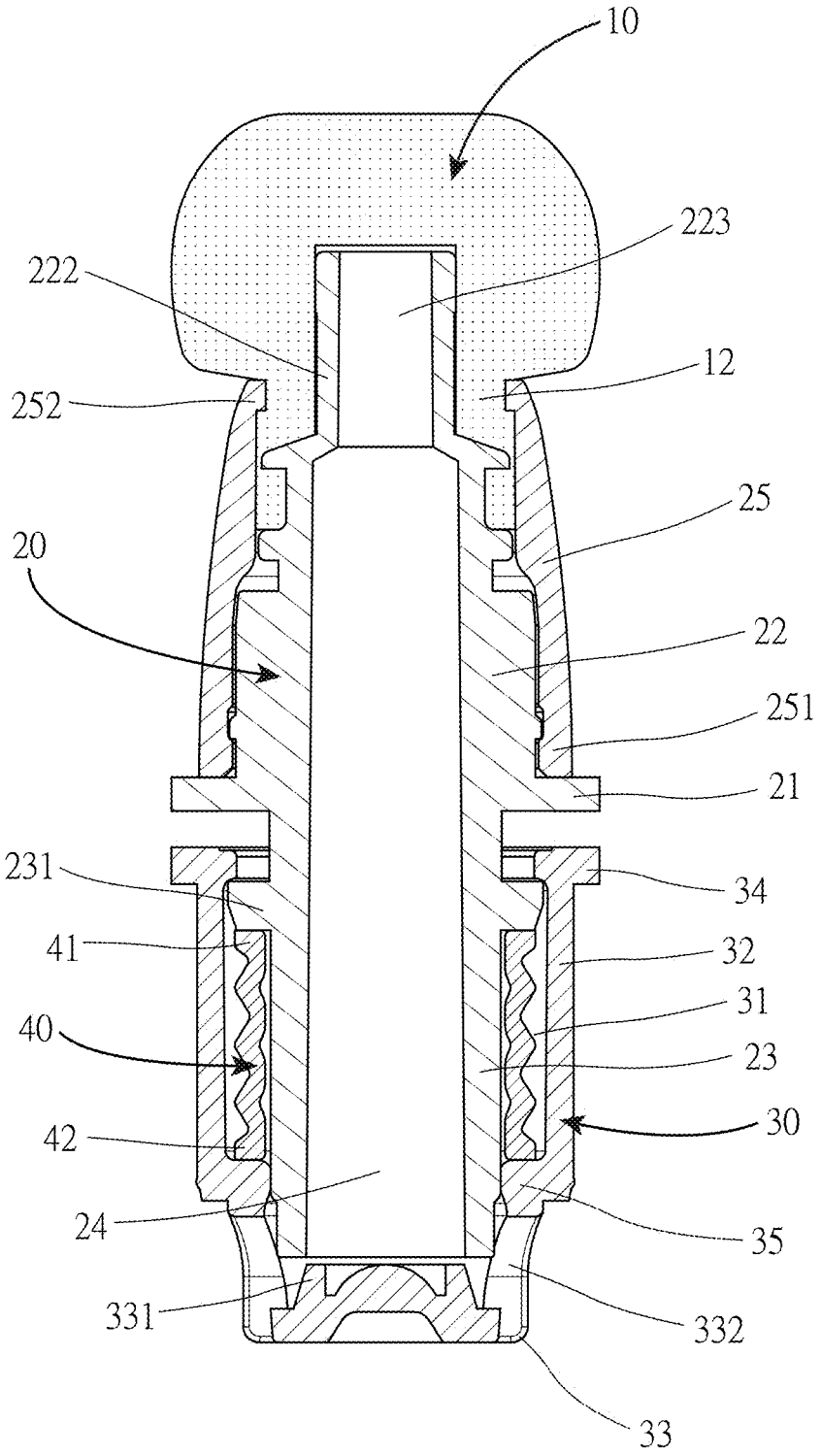
FIG. 10 is a longitudinal sectional view of the environmentally friendly valve in FIG. 8.

Referring to FIGS. 8 to 10, an environmentally friendly valve in accordance with a second preferred embodiment of the invention is shown. The characteristics of the second preferred embodiment are substantially same as that of the first preferred embodiment except the following:

The applicator head 10 is made of sponge. The first dispensing holes 11 are eliminated because the cosmetic fluid can directly pass through the sponge. A joining member 12 extends out of an end of the applicator head 10. The fastening member 22 includes a projecting exit member 222 with the joining member 12 disposed thereon. The exit member 222 has an axial passageway 223 communicating with the channel 24 and thus the second dispensing holes 221 are eliminated in the fastening member 22. The plunger 20 further comprises a hollow constrictive member 25 including a sleeve element 251 at a first end disposed on the fastening member 22 and urging against the first flange 21, and a narrow element 252 at a second end with the joining member 12 fastened therein. As such, the joining member 12 is clamped by and between the fastening member 22 and the constrictive member 25. As a result, the applicator head 10 is fastened. The resilient member 40 has a wavy outer surface and a wavy inner surface. Thus, the compression and the expansion capabilities of the resilient member 40 are greatly increased.

The invention has the following advantages and benefits in comparison with the conventional art: the resilient member 40 is made of flexible plastic material. Thus, the plastic resilient member 40 can be recycled with the plastic applicator head 10, the plastic cap 50 and the plastic casing 60 in one process. It is environmentally friendly. After the plunger 20, the sleeve 30 and the resilient member 40 have been assembled, an airtight valve is implemented by operating same. Air is prevented from entering the casing 60 and any leaked cosmetic fluid is prevented from flowing back to the casing 60. Quality of the cosmetic fluid is maintained. The resilient member 40 is prevented from rusting. A useful life of the cosmetic applicator is prolonged greatly.

While the invention has been described in terms of preferred embodiments, those skilled in the art will recognize that the invention can be practiced with modifications within the spirit and scope of the appended claims.

What is claimed is:

1. A valve, comprising:

an applicator head;

a plunger including an annular first flange, a fastening member projecting from a first end of the annular first flange with the applicator head disposed thereon, a cylinder extending from a second end of the annular first flange, and an axial channel disposed through the plunger;

a sleeve including a main body, an axial space disposed through the main body for receiving the cylinder, a tapered member projecting from a first end of the main body, an annular third flange disposed at a second end of the main body, and at least one exit disposed at an edge of the tapered member, the tapered member communicating with the axial space; and a hollow, cylindrical resilient member made of flexible plastic material and disposed on the cylinder and in the axial space;

wherein the applicator head includes a plurality of first dispensing holes, and the fastening member includes a plurality of second dispensing holes communicating with the axial channel.

2. The valve of claim 1, wherein the applicator head is made of thermoplastic polyester elastomer (TPEE).

3. The valve of claim 1, further comprising an annular second flange on an outer surface of the cylinder adjacent to the annular first flange; and an internal annular shoulder at a joining portion of an inner surface of the main body and an inner surface of the tapered member, the internal annular shoulder urging against an outer surface of the cylinder; wherein the tapered member includes an internal conic projection, and the cylindrical resilient member has a first end urging against the annular second flange, and an opposite second end urging against the internal annular shoulder.

4. The valve of claim 1, wherein the cylindrical resilient member has smooth inner and outer surfaces.

5. The valve of claim 1, wherein the flexible plastic material is silicone or thermoplastic elastomer (TPE).

6. The valve of claim 1, further comprising a joining member extending out of an end of the applicator head, wherein the fastening member includes a projecting exit member with the joining member disposed thereon, the projecting exit member having an axial passageway communicating with the axial channel.

7. The valve of claim 6, wherein the plunger further comprises a hollow constrictive member including a sleeve element at a first end, the sleeve element disposed on the fastening member and urging against the annular first flange, and a narrow element at a second end with the joining member fastened therein so that the joining member is clamped by and between the fastening member and the hollow constrictive member.

8. The valve of claim 6, wherein the applicator head is made of sponge.

9. The valve of claim 6, wherein the cylindrical resilient member has a wavy outer surface and a wavy inner surface.

10. A valve, comprising:

an applicator head;

a plunger including an annular first flange, a fastening member projecting from a first end of the annular first flange with the applicator head disposed thereon, a cylinder extending from a second end of the annular first flange, and an axial channel disposed through the plunger;

a sleeve including a main body, an axial space disposed through the main body for receiving the cylinder, a tapered member projecting from a first end of the main body, an annular third flange disposed at a second end of the main body, and at least one exit disposed at an edge of the tapered member, the tapered member communicating with the axial space;

a hollow, cylindrical resilient member made of flexible plastic material and disposed on the cylinder and in the axial space;

an annular second flange on an outer surface of the cylinder adjacent to the annular first flange; and an internal annular shoulder at a joining portion of an inner surface of the main body and an inner surface of the tapered member, the internal annular shoulder urging against an outer surface of the cylinder;

wherein the tapered member includes an internal conic projection, and the cylindrical resilient member has a first end urging against the annular second flange, and an opposite second end urging against the internal annular shoulder.

11. The valve of claim 10, wherein the applicator head is made of thermoplastic polyester elastomer (TPEE).

12. The valve of claim 10, wherein the cylindrical resilient member has smooth inner and outer surfaces.

13. The valve of claim 10, wherein the flexible plastic material is silicone or thermoplastic elastomer (TPE).

* * * * *